US005263786A

United States Patent [19]

Kageyama

[11] Patent Number: 5,263,786

[45] Date of Patent: Nov. 23, 1993

[54] ROTARY-CAM BALL-POINT PEN

[75] Inventor: Shuhei Kageyama, Kawagoe, Japan

[73] Assignee: Kotobuki & Co., Inc., Kyoto, Japan

[21] Appl. No.: 17,978

[22] Filed: Feb. 12, 1993

Related U.S. Application Data

[63] Continuation of Ser. No. 779,357, Oct. 17, 1991, abandoned.

[51] Int. Cl.[5] ..... B43K 24/08

[52] U.S. Cl. ..... 401/111; 401/112

[58] Field of Search ..... 401/62, 109, 110, 111, 401/112, 113, 114, 33

[56] References Cited

U.S. PATENT DOCUMENTS

| | | | |
|---|---|---|---|
| 3,064,624 | 11/1962 | Hechtle | 401/110 |
| 3,137,276 | 6/1964 | Weisser . | |
| 3,289,638 | 12/1966 | Levoin | 401/110 |
| 3,819,282 | 6/1974 | Schultz | 401/111 X |
| 4,991,988 | 2/1991 | Snell et al. | 401/111 |
| 5,004,364 | 4/1991 | Tomura et al. | 401/110 |

FOREIGN PATENT DOCUMENTS

| | | | |
|---|---|---|---|
| 1129399 | 5/1962 | Fed. Rep. of Germany | 401/111 |
| 1561815 | 4/1970 | Fed. Rep. of Germany | 401/110 |
| 1807078 | 8/1970 | Fed. Rep. of Germany | 401/110 |
| 2040970 | 2/1972 | Fed. Rep. of Germany | 401/110 |

*Primary Examiner*—Danton D. DeMille
*Attorney, Agent, or Firm*—David O'Reilly

[57] ABSTRACT

A rotary-cam ball-point pen having an outer sleeve, a rotary-cam mechanism comprised of a cam body provided on the inside of the outer sleeve, a rotary-cam engaging the cam body, and a cam bar engaging the rotary-cam, and a refill. The rear portion of the refill is loaded backward by an elastic body inserted into the rotary-cam. The cam bar has a structure with flexibility in which the cam bar can be distorted inward by applying a radial force. Since the cam bar is inserted into the outer sleeve from the rear side of the outer sleeve, it is possible to form a clip of an integral part of the cam bar, or a decoration having dimensions larger than the outside diameter, or a knocking cap.

4 Claims, 5 Drawing Sheets

ROTARY-CAM BALL-POINT PEN

This is a continuation of co-pending application Ser. No. 07/779,357 filed on Oct. 17, 1991 now abandoned.

BACKGROUND OF THE INVENTION

1. Field of the Invention

The present invention relates to a rotary-cam ball-point pen in which a refill pen point can be pushed out of the head member of the ball-point pen against the elasticity of an elastic body by knocking the rear end of the ball-point pen. The ball-point pen can be maintained with the pen point pushed out of the head member of the ball-point pen, by a rotary-cam engaging a cam body. The pen point can be withdrawn into the head member of the ball-point pen by the elasticity of the elastic body by releasing the engagement of the rotary-cam with the cam body.

2. Description of the Prior Art

A conventional rotary-cam ball-point pen has an outer sleeve, a rotary-cam mechanism comprised of a cam body provided on the inside of the outer sleeve, a rotary-cam engaging the cam body, and a cam bar engaging the rotary-cam. A refill, being a rear portion is loaded backward by a spring provided between the head member screwed on the forward end of the outer sleeve and a spring bearing formed on the refill so that the rear portion of the refill is forced into the rotary-cam.

In the conventional ball-point pen, when the rotary-cam, cam bar, and refill are set in the outer sleeve, the rotary-cam, cam bar and refill are inserted from the forward end into the outer sleeve under a state where the rear portion of the refill is inserted into the rotary-cam with the cam bar engaging the rotary cam. Projections formed on the cam bar are inserted into grooves formed on the cam body, a spring is put on the forward portion of the refill, and the head member is screwed on the forward end of the outer sleeve. Therefore it is not easy to set up the rotary-cam mechanism and the refill in the outer sleeve and besides since the cam bar is inserted from the forward side of the outer sleeve, it is impossible for the cam bar to be provided with a clip or a decoration having dimensions larger than the outside diameter of the outer sleeve or a knocking-cap being an integral part of the cam bar. Therefore, it is necessary to attach a clip, or a decoration or a knocking cap after setting the cam bar in the outer sleeve. Accordingly, the number of parts is increased, and a long time is required for assembly of parts.

BRIEF DESCRIPTION OF THE INVENTION

It is an object of the present invention to provide an improved ball-point pen in which setting up a rotary-cam mechanism and a refill in an outer sleeve can be easily carried out and a cam bar can be inserted from the rear end of the outer sleeve so that a clip or a decoration or a knocking cap having dimensions larger than the outside diameter of the outer sleeve is possible.

The above-mentioned object is attained by a rotary-cam ball-point pen having an outer sleeve, a rotary-cam mechanism comprised of a cam body provided on the inside of the outer sleeve, a rotary-cam engaging the cam body, and a cam bar engaging the rotary-cam. A refill, has a rear portion loaded backward by an elastic body being inserted into the rotary-cam, wherein the cam bar has a structure with flexibility in which the cam bar can be distorted inward by applying a radial force.

Since a rotary-cam ball-point pen according to the present invention has the above-mentioned structure, when the rotary-cam mechanism and refill are set in the outer sleeve, the rotary-cam mechanism and refill are inserted from the forward end of the outer sleeve in a state where the rear portion of the refill is inserted into the rotary-cam, an elastic body is put on the forward portion of the refill, and the head member is screwed on the forward end of the outer sleeve by which the rotary-cam, the refill, the elastic body and the head member are set up. Thereafter, the cam bar is inserted into the outer sleeve from the rear end of the outer sleeve, while the cam bar is deformed inward by the elasticity of the cam bar, which elasticity enables the projections of the cam bar to get over the rear portion of the cam body into grooves of the cam body by which the attachment of the cam bar to the cam body is made.

According to the present invention, the number of parts is decreased, and less time is required for assembly of parts.

In the present invention, the cam body may be provided with a guide, which guides the projections of the cam bar. By the guide, the projections of the cam body can be easily inserted into the grooves of cam body.

Further, in the present invention, the cam bar may be formed with slits or cuts. The slits or cuts give flexibility to the cam body so that the cam bar can deform inward by applying a radial force to get over the rear portion of the cam body and go into the grooves of the cam body.

The above and other novel festures and advantages of the invention will be more fully understood from the following detailed description and the accompanying drawings.

BRIEF DESCRIPTION OF THE DRAWINGS

In the drawings;

FIG. 3(*b*) illustrates in a perspective view a rotary-cam and the cam bar according to the present invention;

DETAILED DESCRIPTION

Figure 1:
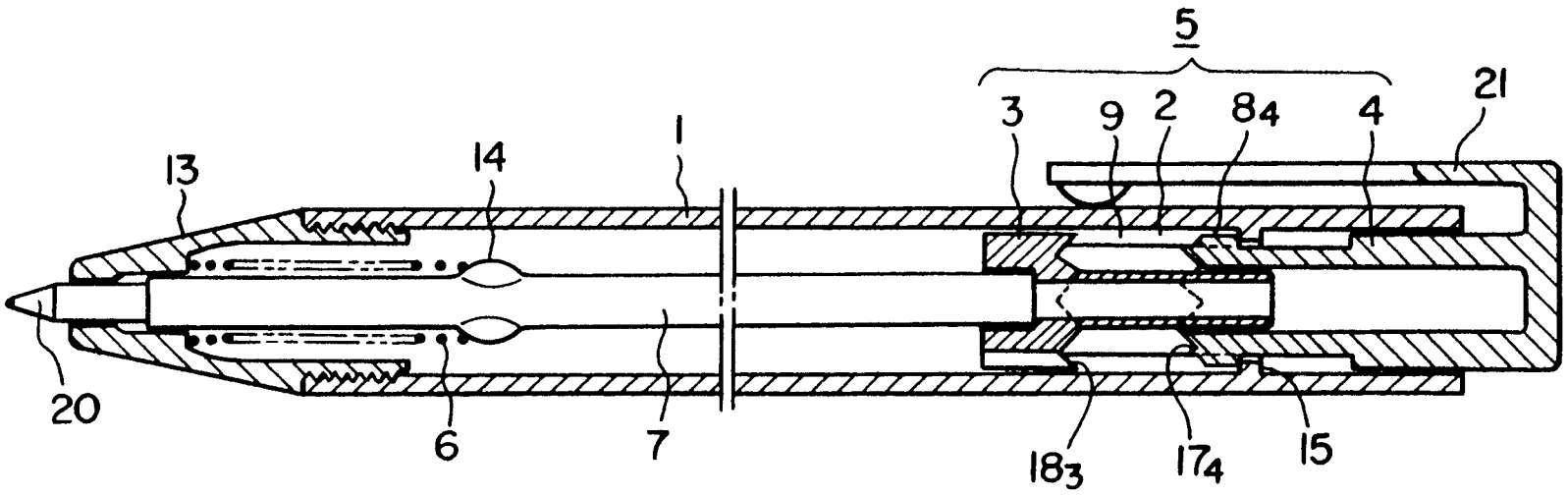
FIG. 1 illustrates in vertical section a first embodiment of a rotary-cam ball-point pen according to the present invention.

Referring to FIG. 1, a rotary-cam ball-point pen according to the present invention comprises outer sleeve 1, and cam mechanism 5 comprised of cam body 2 provided on the inside of the rear part of outer sleeve 1, Rotary-cam 3 engages cam body 2 and cam bar 4 engages rotary cam 3, and refill 7. Cam body 2 may be formed integrally with outer sleeve 1 or cam body 2 may be attached to the inside of outer sleeve 1 by a force fit, adhesion, or screwing. Spring 6 is provided between spring bearing 14 on refill 7 with its rear end is inserted into rotary cam 3 and head member 13 removably screwed on the forward end of outer sleeve 1. The attachment of head member 13 to outer sleeve 1 is made by insertion, engagement, or screwing.

Cam bar 4 has a structure with flexibility in which the cam bar can be distorted inward by applying a radial force. The number of projections $8_4$ of cam bar 4 equals the number of grooves 9 of cam body 2, for example 9, but usually less than 6, or for example 2(FIGS. 3(*a*) and (*b*) ). Pairs of projections are diametrically opposed.

Figure 3A:
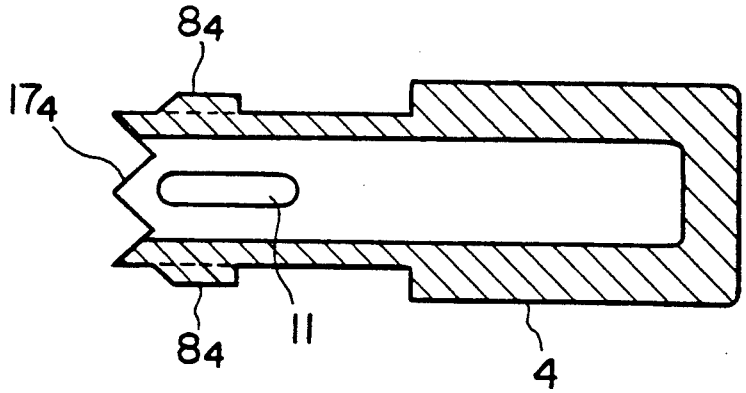
FIG. 3(*a*) illustrates in vertical section a cam bar according to the present invention.
Figure 3B:
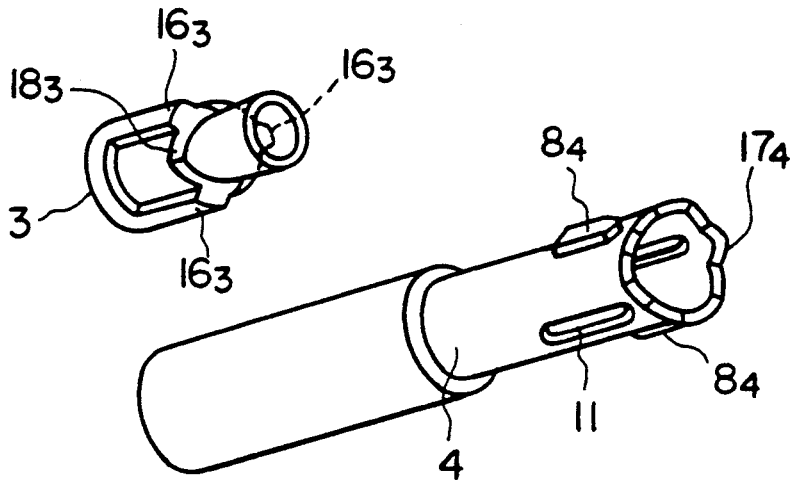

The number of projections $16_3$ of rotary cam 3 is 3 in this case(FIGS. 3(*a*) and (*b*) ).

When the pen point is drawn in, cam faces $17_4$ of cam bar 4 engage cam face $18_3$ of rotation cam 3, and projections $8_4$ of cam bar 4 and projections $16_3$ of rotary-cam 3 are inserted into grooves 9 of cam body 2. Further, the engagement of cam face $18_3$ of rotary cam 3 with cam face $19_2$ of cam body 2, and the insertion of projections $16_3$ of rotary-cam 3 into grooves 9 of cam body 2 are alternatively made. Reference number 21 designates a clip formed integrally with cam bar 4.

Figure 2:
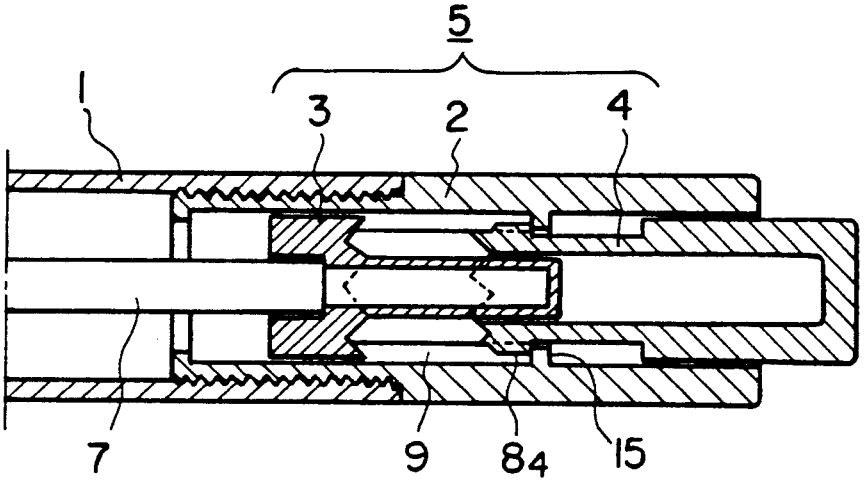
FIG. 2 illustrates in vertical section an important part of a second embodiment of a rotary-cam ball-point pen.

FIG. 2 illustrates in vertical section an important part of a second embodiment which has the same structure as the first embodiment, in which headed cam body 2 is attached to the inside of the rear end of outer sleeve 1 by screwing.

In the first and second embodiments shown in FIGS. 1 and 2, projections $8_4$ of cam bar 4 and projections $16_3$ of rotary-cam 3 are inserted into grooves 9 of cam body 2. When the rear end of cam bar 4 is knocked in a state where cam faces $17_4$ of cam bar 4 engage cam faces $18_3$ of rotary-cam 3, cam bar 4, rotary-cam 3, and refill 7 are moved forward against spring 6 so that pen point 20 of refill 7 is pushed out of head member 13 of outer sleeve 1 while pen point 20 of refill 7 is kept in a state with pen point 20 of refill 7 pushed out of head member 13 of outer sleeve 1 by rotary-cam 3 being turned a given degrees by means of cam faces $17_4$ engaging cam faces $18_3$ so that cam faces $18_3$ rotate to engage cam faces $19_2$ of cam body 2.

When pen point 20 of refill 7 is drawn into head member 13 of outer sleeve 1, the rear end of cam bar 4 is knocked releasing cam faces $18_3$ of rotary cam 3 from cam faces $19_2$ of cam body 2. Thereafter projections $16_3$ of rotary cam 3 and projections $8_4$ of cam bar 4 are inserted into grooves 9 of cam body 2 while refill 7 is moved backward drawing pen point 20 of refill 7 into head member 13.

When rotary-cam mechanism 5 and refill 7 is set in outer sleeve 1, refill 7 is inserted into outer sleeve 1 from the forward end in a state where the rear portion of refill 7 is inserted into rotary cam 3, spring 6 is put on the forward portion of refill 7, then head member 13 is screwed on the forward end of outer sleeve 1 by which rotary cam 3, refill 7, spring 6, and head member 13 are set. Thereafter when cam bar 4 is inserted into outer sleeve 1 from the rear end of outer sleeve 1, cam bar 4 deforms inward by the elasticity of cam bar 4, which enables projections $8_4$ of cam bar 4 to get over the rear portion 15 of cam body 2 and to enter grooves 9 of cam body 2 so that the cam bar can be set. In this case, cam bar 4 is deformed inward while the rear portion 15 of cam body 2 is deformed slightly outward, which facilitates setting cam bar 4.

Therefore, since cam bar 4 is inserted into outer sleeve 1 from the rear side, it is possible to form a clip 21 from the integral part of cam bar 4 (FIG. 1), or a decoration having a size larger than the outside diameter, or a knocking cap.

Figure 4:
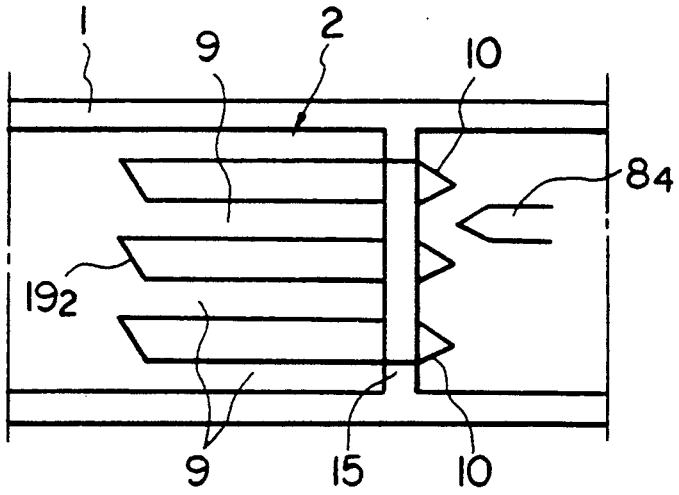
FIG. 4 is a schematic illustration of a cam body according to the present invention.

In the present invention, cam body 2 may be provided with guide 10 as shown in FIG. 4, which guides projections $8_4$ of cam bar 4 so that the projections are easily inserted into grooves 9 of cam body 2.

Figure 5:
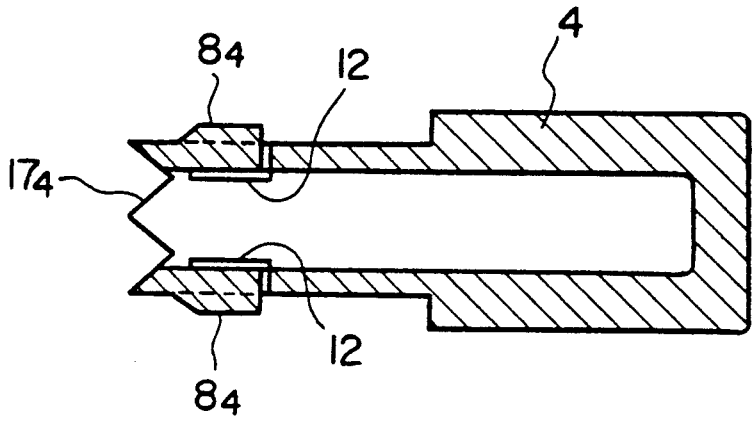
FIGS. 5 and 6 show another embodiment of a cam bar of the present invention, FIG. 5 being a vertical section thereof and FIG. 6 being a plan view thereof.
Figure 6:
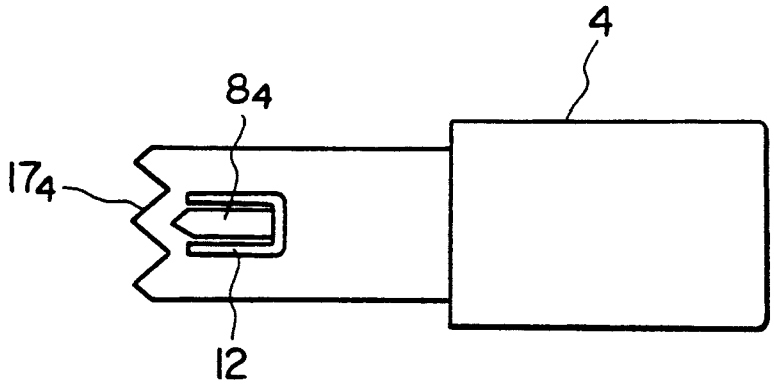
Figure 7:
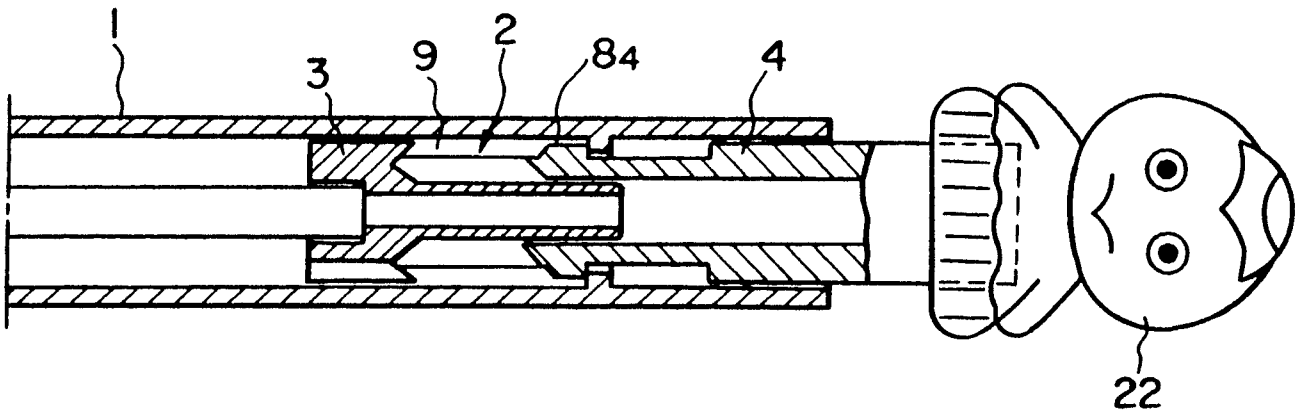
FIG. 7 shows in vertical section an important part of a third embodiment of a rotary-cam ball-point pen.

Further, in the present invention, cam bar may be formed with slit 11(FIG. 3(*a*)), or cut 12(FIGS. 5 and 6), which facilitates cam bar 4 deforming inward to get over rear portion 15 of cam body 2 to enter into grooves 9 of cam body 2. Slits 11 may be slits having one side open.

This invention is not to be limited to the embodiment shown in the drawing and described in the description, which is given by way of example and not of limitation, but only in accordance with the scope of the appended claims.

What is claimed is:

1. A rotary-cam ball-point pen comprising; an outer sleeve; a cam body attached to said outer sleeve; a rotary cam having a plurality of cam faces and a socket, said rotary cam engaging said cam body; writing refill means having one end inserted in said socket in said rotary-cam; a cam bar having cam faces engaging the cam faces on said rotary cam and extending beyond the end of said outer sleeve; biasing means biasing said writing refill toward and into engagement with said rotary cam; securing means securing said cam bar to said cam body; said cam bar having a plurality of projections on an exterior surface adjacent a portion engaging said rotary cam; said projections being on a deformable portion of said cam bar for passing over said securing means; a plurality of grooves in said cam body for receiving said projections on said cam bar for axial movement, the number of projections on said cam bar being less than the number of grooves in said cam body; said rotary cam having projections for engaging said grooves in said cam body; whereby an axial force on the end of said cam bar extending beyond the end of said outer sleeve causes said rotary-cam to rotate thereby extending or retracting said writing refill from said outer sleeve.

2. The rotary-cam ball-point pen according to claim 1 in which said securing means comprises a raised portion on the inside of said cam body; said projections passing over said raised portion when they deform.

3. The rotary-cam ball-point pen according to claim 1 in which said cam body is attached to said outer sleeve by threads on one end engaging threads on an end of said outer sleeve.

4. The rotary-cam ball-point pen according to claim 2 in which said cam body has guides in a rear portion for receiving said projections on said cam bar.

* * * * *